United States Patent [19]

Ryan

[11] Patent Number: 4,773,586

[45] Date of Patent: Sep. 27, 1988

[54] BLOWER CONTROL CIRCUIT FOR A FURNACE

[75] Inventor: Jerry D. Ryan, Fort Wayne, Ind.

[73] Assignee: Hamilton Standard Controls Inc., Farmington, Conn.

[21] Appl. No.: 28,264

[22] Filed: Mar. 20, 1987

[51] Int. Cl.[4] ..... F24D 5/10

[52] U.S. Cl. ..... 236/11; 236/46 F

[58] Field of Search ..... 236/11, 10, 46 F, 9 A, 236/9 R

[56] References Cited

U.S. PATENT DOCUMENTS

| | | | |
|---|---|---|---|
| 3,921,899 | 11/1975 | Hamilton | 236/9 A |
| 4,140,274 | 2/1979 | Nabinger | 236/11 |
| 4,189,091 | 2/1980 | Ballard et al. | 236/11 |
| 4,234,124 | 11/1980 | Yarrow | 236/46 F X |
| 4,290,274 | 9/1981 | Essex | 236/46 F X |
| 4,373,662 | 2/1983 | Bassett et al. | 236/10 |
| 4,502,625 | 3/1985 | Mueller | 236/11 |
| 4,684,060 | 8/1987 | Adams et al. | 236/11 |

*Primary Examiner*—Harry B. Tanner

[57] ABSTRACT

A blower control circuit for a furnace includes a blower relay having normally-open contacts connected in the power circuit to the blower. Energization of the relay via a drive circuit serves to close the contacts and thereby operate the blower. Control of the drive circuit resulting in relay energization is effected by either a time-delay circuit which responds to a space thermostat or a safety sense circuit which responds to a high temperature limit thermostat.

6 Claims, 2 Drawing Sheets

BLOWER CONTROL CIRCUIT FOR A FURNACE

DESCRIPTION

1. Technical Field

The invention relates generally to a control circuit for a furnace and more particularly to a control circuit for an air circulating blower in a hot air furnace.

2. Background Art

Many types of blower controls have previously been used to provide safe and efficient operation of a hot air furnace. Blower operation is optimally designed to allow the furnace heat exchanger to achieve operating temperatures prior to blower operation and to allow the heat exchanger to cool before blower operation is discontinued. An over-temperature limit switch in the event of high bonnet temperature is also usually included as a safety feature to commence blower operation regardless of the temperature of the space to be heated should the bonnet temperature within the furnace reach a predetermined high level.

One such method of controlling a furnace blower is by an electro-mechanical thermostatic switch that is placed in the heat exchanger to monitor the air temperature. This thermostatic switch, commonly called a helical thermostat, is designed with two switch points. The furnace blower is turned on (operated) when the air temperature reaches or exceeds the lower set point and is turned off when the air temperature falls below that set point. In such instance, a delay function for the furnace blower is performed by the measurement of the air temperature. The delay in turning the blower "on" is to avoid the blowing of cold air throughout the system before the furnace is able to adequately heat the heat exchanger. The delay in turning the blower "off" is to use the residual heat in the chamber after the flame is extinguished and further, to cool the furnace after the heating requirement has been met. A second function of the helical thermostat is to terminate electrical power to the gas valve solenoid in the event of excessive heat build-up in the furnace resulting from restricted or blocked airflow. This is performed by the second and higher switch point of the helical thermostat.

The helical thermostat is an electro-mechanical device which is costly and may have long-term reliability problems. Replacement of this device by an electronic control offers reliability, versatility, delay functions and power switching in one module. It further offers the opportunity of reduced system wiring and certain other cost advantages.

One such electronic control for a furnace blower is disclosed in U.S. Pat. No. 4,189,091 to Ballard et al for Furnace Having A Normally Closed Blower Relay issued Feb. 19, 1980 and assigned to a sister company of the assignee of the present invention. In that patent a blower control circuit is described for use with the electric blower which circulates the heated air of a furnace. A relay having normally-closed contacts is utilized for connecting and disconnecting the blower respectively to and from the power source. The relay is in turn controlled by a time-delay relay circuit which is connected to and receives an input from the space thermostat and which in turn includes particular timing circuitry for creating an electrical relay control signal upon elapse of a delay period after the receipt of the space thermostat signal and for maintaining that relay control signal until elapse of the delay period after the discontinuance of the space thermostat signal. That timing circuitry typically employs RC time constants acting in cooperation with a Schmidt trigger or similar form of comparator for determining the delay intervals and effecting the resulting control. The use of normally-closed relay contacts for the blower motor is for the purpose of allowing blower operation in the event of a control circuit failure, such as loss of current or voltage within the control circuit or the blower relay. This, of course, presumes continued availability of the power source for the blower motor itself. A normally-closed temperature limit switch is connected in series with the blower relay power source such that when it opens the power is removed from the relay, thereby allowing the contacts to close and to commence blower operation.

While the aforementioned electronic control for a furnace blower overcomes many of the aforementioned limitations of an electro-mechanical helical thermostat, it does require the use of a relay having normally-closed contacts for connecting/disconnecting the blower motor relative to its power source. Unfortunately, the use of normally-closed relay contacts for the blower motor presents certain concomitant limitations. For instance, such relay must be energized when the blower is not required and may thereby result in an excessive consumption of electrical power. Further, the reliability of a relay is degraded by the length of time it is energized. Still further, a normally-open relay is typically more reliable than a normally-closed relay when switching large motor loads. Thus, for comparable functions and longevity, the normally-closed relay is typically somewhat more expensive than a suitable normally-open relay.

SUMMARY OF THE INVENTION

Accordingly, it is a principal object of the present invention to provide an improved control circuit for a furnace blower which is reliable and particularly cost effective. Included within this object is the provision of a blower control circuit possessing the functional capabilities of conventional circuitry existing in the prior art but attaining such end at reduced cost.

It is a further object of the invention to provide an economical and reliable control circuit for a hot air furnace.

In accordance with the invention there is provided an improved blower control circuit for use in a furnace having a fuel burner supplied by a fuel regulator and further including a heat exchanger fired by the burner having a flue gas passage and a heated air passage, and a blower powered by an electric motor for displacing the heated air. A space thermostat determines when heating is required. A limit thermostat determines when a high temperature limit is exceeded. A power source is provided for supplying current to the furnace blower motor, the space thermostat, the limit thermostat and the blower control circuit. The blower control circuit includes a time-delay relay circuit and blower relay contacts for selectively connecting and disconnecting the blower motor with the power source. The time-delay relay circuit is connected to the space thermostat such that when heating is required, an electrical signal is received from the space thermostat. The time-delay relay circuit includes timing means for creating a first electrical relay control signal upon elapse of a delay period after the receipt of the space thermostat signal and for maintaining that first signal until elapse of the delay period after the discontinuance of the space thermostat signal.

The improvement particularly comprises the blower relay contacts being of the normally-open type and the further inclusion of a safety sense relay circuit and particular relay drive means. The safety sense relay circuit is energized by the power source and is connected and responds to the limit thermostat for providing a second electrical relay control signal while the high temperature limit is exceeded for controlling the blower relay contacts. The relay drive means is responsive to either of the first and second electrical relay control signals for closing the blower relay contacts.

The limit thermostat is preferably a relatively inexpensive, normally-closed, disc thermostat. The timing means for the time-delay relay circuit is preferably provided by a pair of conventional oscillator/timer integrated circuits connected to provide the first electrical relay control signal in response to the space thermostat signal. A safety sense relay circuit responds to the opening of the limit thermostat for providing the second electrical relay control signal while the high temperature limit is exceeded. The relay drive means may conveniently include a semiconductor switch which responds to either of the first and second electrical relay control signals for energizing the blower relay to close its contacts and thereby energize the blower.

BEST MODE FOR CARRYING OUT THE INVENTION

The embodiment of the invention described below is adapted for use in a residential furnace application, although it is to be understood that the invention finds like applicability in other forms of furnaces and various heating implements. The furnace control circuits described below will have equal import to circuits for use with other heating instruments including commercial and industrial uses.

The typical hot air furnace has a heat exchanger fired by a burner, usually using natural gas or fuel oil as a source of energy, and a fuel regulator or valve controlling the amount of fuel flow to the burner. The fuel is burned within the heat exchanger and exhaust gases travel the length of the heat exchanger and are discharged into the atmosphere externally of the enclosure to be heated. Room air to be heated is circulated or displaced over the outside of the heat exchanger by a blower, thereby absorbing heat from the flue gases. This now-heated air is circulated to the areas to be heated and simultaneously cold air may be withdrawn from those areas.

Figure 1:
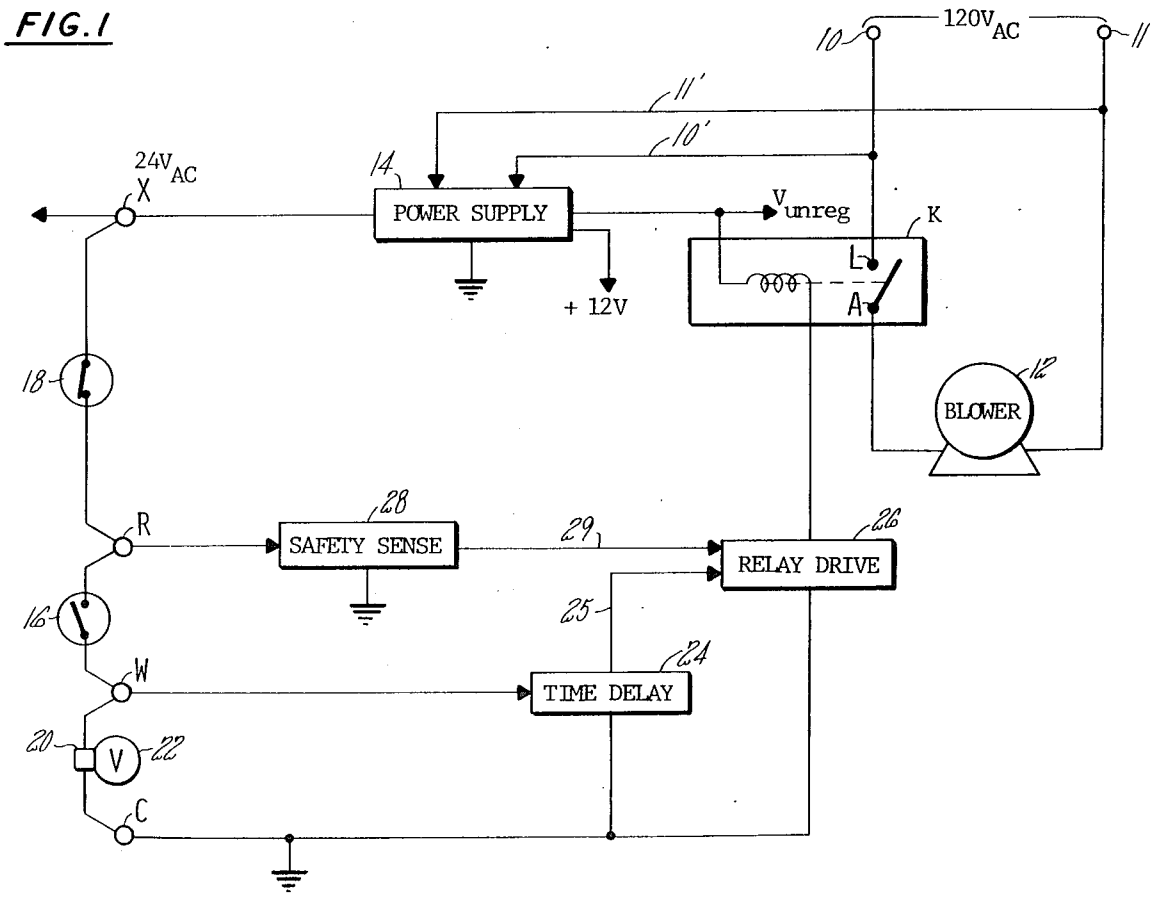
FIG. 1 is a schematic block diagram of a control system for a furnace blower in accordance with the invention.

Referring to the drawings, FIG. 1 is a schematic block diagram of the relevant portions of a furnace blower control system in accordance with the present invention. 120 volt AC electrical power is extended to the furnace for powering various electrical motors and to provide a source for lower-voltage AC and DC supplies. 120 $V_{AC}$ appears across terminals 10 and 11 for extension to a blower motor 12 via the contacts of a normally-open relay K in series with blower motor 12. A pair of leads 10' and 11' extend from terminals 10 and 11 respectively, to power supply circuitry 14, here depicted as combined in one unit, for providing other lower voltages. Power supply 14 here impliedly includes a step-down transformer (not shown) for converting 120 $V_{AC}$ to 24 $V_{AC}$, which latter potential appears at terminal X for utilization by various thermostats and other portions of the control circuitry. Power supply 14 additionally provides a source of rectified, unregulated potential, $V_{unreg}$, for supplying the coil of the blower relay K. The power supply 14 also provides a regulated 12 $V_{DC}$ supply for use by various semiconductor circuits to be hereinafter described in greater detail. In actuality, the step-down transformer is typically associated directly with the circuitry of the furnace, and the DC voltages are derived at the circuit board for the controls by extension of the 24 $V_{AC}$ thereto.

The contacts A and L of the blower relay K are of the normally-open type in accordance with the present invention. Accordingly, to effect operation of blower motor 12 it is necessary to energize relay K and thereby close the contacts A and L. Energization of relay K is controlled by the states of a room or space thermostat 16 and a high temperature limit thermostat 18. The high temperature limit thermostat 18 is preferably of a relatively inexpensive disc-type and is normally closed. It typically only opens when the temperature in the region of the furnace heat exchanger exceeds some safe limit, i.e. 200° F. The space thermostat 16 is typically of the adjustable type and remains open so long as the system is in a heating mode and the temperature in the region of the thermostat exceeds some preset threshold value. When the temperature falls below that threshold, the contacts of thermostats 16 close in a known manner. A relay 20 associated with gas valve 22 serves to regulate the flow of gas or oil to the furnace burner. Relay 20 is connected across terminals C and W, with terminal C being electrically connected to ground. Space thermostat 16 is connected across terminals W and R. High temperature limit thermostat 18 is connected across terminals R and X, with a 24 $V_{AC}$ potential appearing at terminal X. Accordingly, 24 $V_{AC}$ operating potential is available to the space thermostat 16 only if the high temperature limit thermostat 18 remains closed. Further still, energization of the gas control solenoid 20 for admitting gas to the burner is permitted only if a demand is created by closure of the space thermostat 16 and the high temperature limit thermostat 18 remains closed, as indicative of a safe condition.

Delay for the turn-on and for the turn-off of the blower 12 following start-up and shut-down of the burner respectively, is determined by a time-delay circuit 24 receiving an input from space thermostat 16 at terminal W. Time-delay circuit 24 serves to output a relay control signal via lead 25 to a relay drive element or circuit 26. However, such control will only provide power to the blower 12 via the blower relay K when a call for heat is present from the space thermostat 16. Therefore, the requirement for the blower 12 to operate during an over-temperature condition must be met by other means, since the demand of the space thermostat 16 will usually have been satisfied in most instances. Accordingly, the high temperature limit thermostat 18 is connected to terminal R which constitutes an input to a safety sense circuit 28 which is capable of providing a second relay control signal via lead 29 to relay drive element 26 whenever a high-temperature condition causes thermostat 18 to open.

Figure 2:
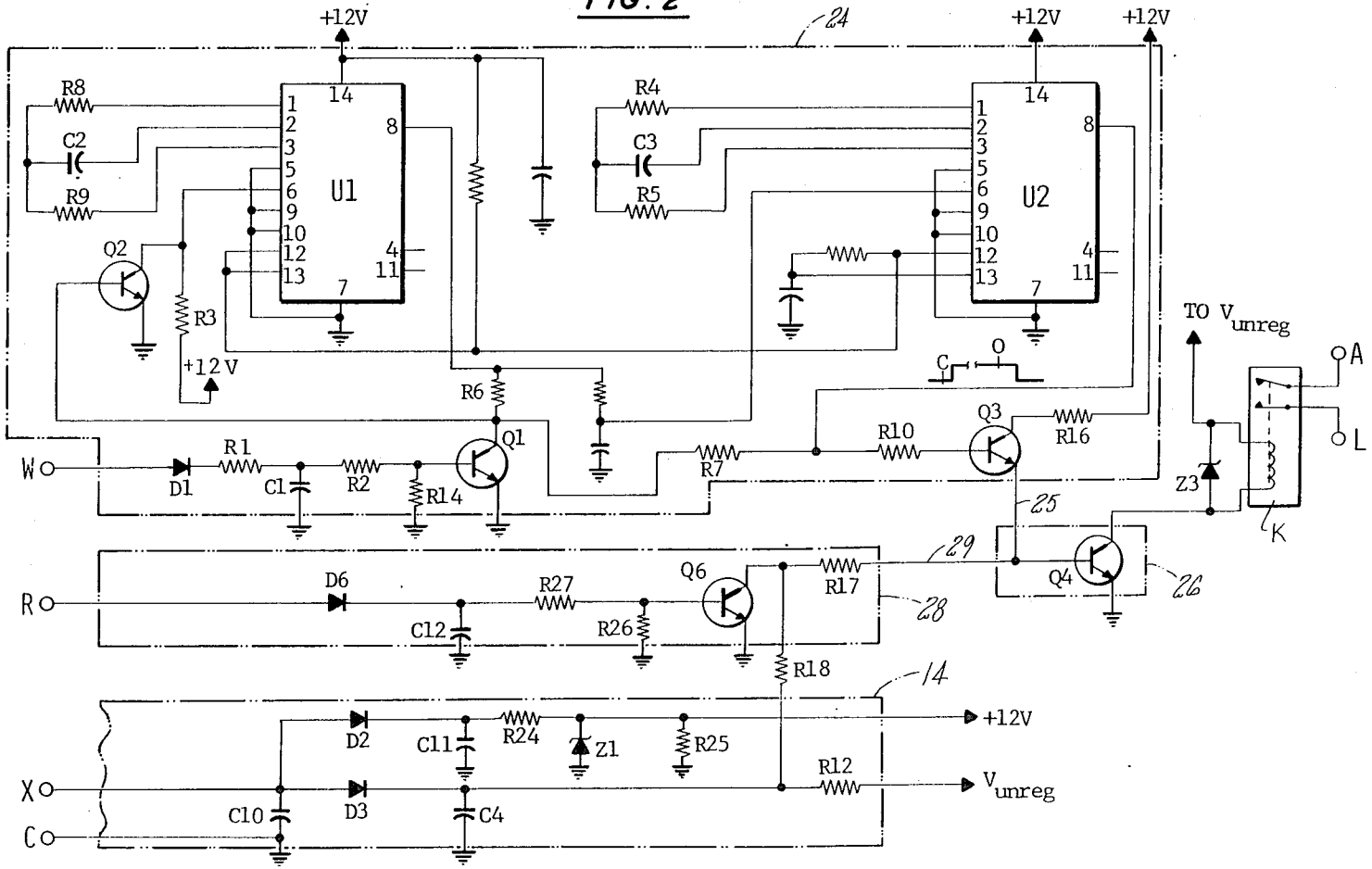
FIG. 2 is a detailed schematic diagram of the circuitry contained in relevant portions of the block diagram of FIG. 1.

Referring to FIG. 2, the control circuitry for furnace blower 12 is depicted in greater detail. Although the high limit thermostat 18, the space thermostat 16, the fuel valve 22 and its solenoid 20 and the furnace blower motor 12 are omitted from FIG. 2, their points of connection with that circuitry will be evident through reference to FIG. 1. The several functional sections of FIG. 2 which correspond with labeled blocks in FIG. 1 are contained within broken line enclosures having the same reference numerals.

The stepped-down 24 $V_{AC}$ potential appearing across terminals X and C may be developed remotely from the electronics depicted in the remainder of FIG. 2, and is further developed in FIG. 2 into an unregulated, rectified potential $V_{unreg}$ via the parallel connection of a pair of capacitors C10 and C4 including an intermediate serial rectifying D3 and a resistor R12 at the output thereof. Similarly, a regulated 12 $V_{DC}$ potential is derived via connection of a rectifying diode D2 to the X terminal and subsequently filtering and appropriately regulating the rectified potential to provide the regulated 12 $V_{DC}$. The filtering and regulation is afforded via a conventional network including parallel capacitor C11, series resistor R24, a shunt zener diode Z1 to regulate the voltage level, and an output resistor R25 connected in parallel with the zener diode. This power supply arrangement generally ensures that so long as there is power available to the coil of relay K, there will also be power available to the associated control electronics and thermostats, and vice versa.

With reference to the time-delay relay circuitry generally embraced within the dotted line 24, terminal W serves as the input by which a 24 $V_{AC}$ potential may be applied thereto via space thermostat 16 when it closes, assuming temperature limit thermostat 18 has also remained closed. The 24 V signal provided by space thermostat 16 is applied to terminal W and is thereafter rectified by diode D1 and filtered to develop a representative DC control level applied to the base of a transistor switch Q1 via a filtering and level-settinq network comprised of series resistor R1, parallel capacitor C1, series resistor R2, and parallel resistor R14. The values of resistors R1 and R2 typically are 100K ohm, capacitor C1 is 4.7 microfarads and resistor R14 is 15K ohm, such that the transistor Q1 is biased into conduction whenever the AC potential at terminal W exceeds about 15 volts, thereby signifying closure of space thermostat 16. In the absence of such potential at terminal W, transistor Q1 is nonconducting.

The collector of transistor Q1 is connected to the base of Q2 which in turn has its collector connected through a load resistor R3 to the 12 V supply. The collector of transistor Q2 is additionally connected to the Master Reset input pin 6 of an oscillator/timer integrated circuit U1 of a conventional type, such as the Model 4541 by Motorola. A load resistor R6 is connected between output pin 8 of oscillator/timer U2 and the collector of transistor Q1. A similar load resistor R7 is connected between the collector of transistor Q1 and the output pin 8 of a second oscillator/timer U2 identical to oscillator/timer U1.

When transistor Q1 is biased into conduction by closure of space thermostat 16, transistor Q2 will similarly be switched into conduction, thereby switching the signal at the input pin 6 of oscillator/timer U1 from a "high" 12 V level to a "low" level, near ground. The oscillator/timer U1 includes resistor R8, capacitor C2, and resistor R9 connected in common at one end and respectively connected at their other ends to input pins 1, 2 and 3 of the oscillator/timer in a known manner to establish the frequency of the oscillator portion of the IC chip. The values of the resistance and capacitance may be selected to provide the desired frequency for the included number of stages of the timer thereby to provide the requisite timing function.

Oscillator/timer U1 serves to provide the "off" delay between the turn-off of the furnace burner upon satisfaction of space thermostat 16 and the subsequent turn-off of the furnace blower 12. In the present instance that delay is typically about two minutes. Concomitantly, the delay between ignition at the furnace burner and the start-up of furnace blower 12 is referred to as the "on" delay and is provided by oscillator/timer U2. In the present instance that delay is typically one minute. As with oscillator/timer U1, resistor R4, capacitor C3 and resistor 5, connected in common at one ends and respectively to input pins 1, 2 and 3 of U2 at their other end serve to establish the desired frequency for the oscillator of U2. As for circuit U1, pin 6 of circuit U2 serves as the Master Reset and is connected to pin 8 of circuit U1 to receive the output therefrom.

The output of oscillator/timer U2 is extended via pin 8 thereof, to one end of a resistor R10 having its other end connected to the base of transistor Q3. A load resistor R16 extends from the collector of transistor Q3 to the +12 V supply. The signal appearing at the junction between resistor R7, resistor R10 and output pin 8 of oscillator/timer U2 will constitute a rectangular waveform which is normally logically "low", i.e. ground, when space thermostat 16 is satisfied prior to burner ignition and for approximately one minute following burner ignition. That signal then goes logically "high", i.e. +12 V, for the interval thereafter during which the space thermostat 16 remains closed and for the further "off" delay interval of two minutes following termination of combustion at the burner due to thermostat 16 reopening. The oscillator/timers U1 and U2 are interconnected with one another and with the thermostat-responsive switching transistors Q1 and Q2 such that timer U2 counts a one minute interval following ignition and counter U1 counts a two minute interval following satisfaction of thermostat 16 and termination of ignition. The resultant square wave signal is depicted adjacent the the junction of resistors R7, R10 and U2 pin 8. The two reference marks C and 0 on the waveform respectively designate "closure" and "opening" of the space thermostat 16. That signal is amplified by transistor Q3 and appears as the time-delayed relay control signal on lead 25.

The development of the relay control signal on lead 25 as a feed-thru function of the waveform appearing at the output pin 8 of oscillator/timer U2 is determined to some extent by the additional circuitry of the safety sense circuit 28 as will be hereinafter more clearly understood.

Reference is now made to the safety sense circuit 28 having its input terminal R connected to one side of the normally-closed high temperature limit thermostat 18. With thermostat 18 closed, 24 $V_{AC}$ is applied to the input terminal R where it is rectified bY diode D6 into pulsed DC. The pulsed DC voltage is filtered by energy storage capacitor C12 which may typically be 4.7 microfarads. The resulting smoothed DC voltage is applied to the base of a transistor Q6 through a current-limiting resistor R27 of 200K ohm. A further resistor R26 of 47 K ohm is connected between the base of transistor Q6 and ground both to facilitate the filtering function and to serve a voltage-dividing function for establishing the level of the potential applied to the base of the transistor.

Assuming 24 $V_{AC}$ at input terminal R, the resulting voltage at the base of transistor Q6 biases that transistor to the "on" state, resulting in the junction of the transistor's collector with pull-up resistor R18 of 15K ohm and resistor R17 of 1 K ohm being held to circuit ground potential. The other end of resistor R17 is connected via lead 29 to the junction of lead 25 from the collector of transistor Q3 and is further in junction with the base of a switchable drive transistor Q4 in the drive circuit 26. Since the collector of Q6 is being held substantially at ground, the base of transistor Q4 will also be at similar potential, thus resulting in that transistor being biased "off". This assumes that the output signal appearing on lead 25 of delay circuit 24 is also near ground, as prior to burner ignition.

Transistor Q4 has its emitter connected to ground and its collector connected to one side of the coil of blower relay K, the other side of the coil being connected to $V_{unreg}$. With the transistor Q4 "off",relay K is not energized and the blower 12 thus does not run. In this mode, however, relay K may be energized and de-energized by the delay-time circuitry 24 via transistor Q3 and lead 25 connected to the base of transistor Q4 to provide normal control of the blower in response to heating demands. This is possible even though the transistor Q6 is normally "on" because conduction by transistor Q3 raises the potential at the base of transistor Q4 via the voltage divider network afforded by resistor R16 of 4.7K ohm and resistor R17 of 1K ohm.

In the event an over-temperature condition does occur in the furnace heat exchanger, the disc thermostat 18 opens and removes the 24 $V_{AC}$ from input terminal R. With that voltage absent, the capacitor Cl2 discharges through resistor R27 into the base of transistor Q6 until the voltage at the base is not sufficient to maintain the transistor in the "on" state. With transistor Q6 "off",the junction of the collector of transistor Q6 with resistors R18 and R17, is pulled up toward the higher voltage level of the voltage supply $V_{unreg}$. The resulting voltage level biases transistor Q4 "on" through current-limiting resistor R17 connected to its base, thereby resulting in relay K1 being energized and supplying power to the blower motor 12 through the resulting closure of the normally-open contacts A, L. The blower will continue to run until the over-temperature condition is removed from the furnace as signaled by the closin of the limit thermostat 18. While the control is in the over-temperature-run mode, the operation of the delay-timer circuitry 24 and transistor Q3 thereof will have no effect on transistor Q4 and the relay K.

Although this invention has been shown and described with respect to detailed embodiments thereof, it will be understood by those skilled in the art that various changes in form and detail thereof may be made without departing from the spirit and scope of the claimed invention.

Having thus described a typical embodiment of the invention, that which is claimed as new and desired to be secured by Letters Patent of the United States is:

1. In a furnace having a fuel burner supplied by a fuel regulator, a heat exchanger fired by the burner having a flue gas passage and a heated air passage, a blower powered by an electric motor for displacing the heated air, a space thermostat for determining when heating is required, a limit thermostat for determining when a high temperature limit is exceeded, a power source for supplying current to the furnace blower motor, the space thermostat and the limit thermostat, and a blower control circuit, the blower control circuit including a time-delay relay circuit, and a blower relay having contacts for connecting and disconnecting the blower motor with the power source, said time-delay relay circuit being energized by the power source and being connected to the space thermostat such that when heating is required an electric signal is received from the space thermostat, the time-delay relay circuit including timing means for creating a first electrical relay control signal upon elapse of a delay period after the receipt of the space thermostat siqnal and for maintaininq said first signal until elapse of the delav period after the discontinuance of the space thermostat siqnal, the improvement comprising:

said blower relay contacts being normally-open;

a safety sense relay circuit energized by the power source and being connected and responding to said limit thermostat for providing a second electrical relay control signal while said high temperature limit is exceeded for controlling the blower relay contacts; and relay drive means responsive to either of said first and second electrical relay control signals for closing said blower relay contacts.

2. The improvement of claim 1 wherein said relay contacts are controlled by an associated relay coil and said relay drive means comprises a semiconductor switch connected in series with said relay coil and having a control electrode to which said first and second electrical relay control signals are operatively connected.

3. The improvement of claim 2 wherein said semiconductor switch is normally biased "off" in the absence of both of said first and second electrical relay control signals.

4. The improvement of claim 1 wherein the current supplied by said power source to said limit thermostat is AC such that said limit thermostat, when closed, provides an AC voltage to said safety sense relay circuit, and said safety sense relay circuit comprises rectification and scaling means for converting the AC voltage to a DC control voltage and semiconductor switch means having a control electrode, said DC control voltage being coupled to said control electrode for controlling the conductivity of said semiconductor switch means, and said semiconductor switch means being connected to said relay drive means for providing said second electrical relay control signal for closing said blower relay contacts.

5. The improvement of claim 1 wherein said timing means of said time-delay relay circuit comprises a pair of integrated, interconnected oscillator/timer circuits, one of said oscillator/timer circuits being responsive to the initiation of said electrical signal received from said space thermostat for timing an "on" delay interval before initiating said first electrical relay control signal and the other of said oscillator/timer circuits being responsive to the termination of said electrical signal received from said space thermostat for timing an "off" delay interval before terminating said first electrical relay control signal.

6. The improvement of claim 4 wherein said limit thermostat is normally-closed and is opened when said high temperature limit is exceeded, said semiconductor switch means being conductive while said DC control voltage is applied to said control electrode and otherwise being non-conductive, and wherein non-conduction by said semiconductor switch means provides said second electrical relay control signal.

* * * * *